US006204777B1

(12) United States Patent
Lyons

(10) Patent No.: US 6,204,777 B1
(45) Date of Patent: Mar. 20, 2001

(54) PORTABLE ILLUMINATED WARNING SIGN

(75) Inventor: Harold W. Lyons, Edgewater, FL (US)

(73) Assignee: Whelen Engineering Company, Inc., Chester, CT (US)

( * ) Notice: Subject to any disclaimer, the term of this patent is extended or adjusted under 35 U.S.C. 154(b) by 0 days.

(21) Appl. No.: 09/333,246

(22) Filed: Jun. 15, 1999

(51) Int. Cl.[7] ..... G08G 1/095

(52) U.S. Cl. ..... 340/908; 340/321; 340/907; 40/586; 40/606

(58) Field of Search ..... 340/908, 321, 340/907; 40/586, 606

(56) References Cited

U.S. PATENT DOCUMENTS 3,821,860 * 7/1974 Patty .
4,235,033 * 11/1980 Eilers ..... 40/586
4,271,408 * 6/1981 Teshima et al. ..... 340/702
5,023,607 * 6/1991 Staten ..... 340/908.1
5,276,424 * 1/1994 Hegeman ..... 340/321
5,755,051 * 5/1998 Zumbuhl ..... 40/586
5,819,455 * 10/1998 Tsuda ..... 40/580
6,035,567 * 3/2000 Cameron ..... 40/606

* cited by examiner

*Primary Examiner*—Daniel J. Wu
*Assistant Examiner*—Tai T. Nguyen
(74) *Attorney, Agent, or Firm*—Alix, Yale & Ristas, LLP

(57) ABSTRACT

LED arrays which reinforce the printed message are incorporated in hand held warning signs. Power for the LED arrays is provided by a rechargeable battery included within the base on which the sign is rotatably supported from the ground.

16 Claims, 4 Drawing Sheets

PORTABLE ILLUMINATED WARNING SIGN

BACKGROUND OF THE INVENTION

1. Field of the Invention

The present invention relates to enhancing the visibility of portable warning devices and, particularly, to increasing the conspicuousness of manually supported warning signs. More specifically, this invention is directed to improvements in and to warning signs of the type commonly employed in construction areas and, especially, to the incorporation of a periodically energized illuminated message into a manually supported warning sign. Accordingly, the general objects of the present invention are to provide novel and improved methods and apparatus of such character.

2. Description of the Prior Art

It is common practice to employ "flag men" to control traffic flow in highway construction zones. These individuals manipulate passive signs which bear short, lettered, instruction messages, i.e., "SLOW" or "STOP". The instructions are usually provided on opposite planar sides of a sign board, and that sign board is typically mounted on the top of a pole, the opposite end of the pole being positioned on the ground. The instruction transmitted to an approaching motorist is thus changeable by simply rotating the pole so that the appropriate message is presented to approaching traffic.

For many reasons, including the fact that construction zones are often characterized by a dusty environment which reduces visibility, there has been a long standing desire to increase the noticeability of portable warning signs of the type briefly described above. Obviously, any such visibility enhancements must be accomplished without significantly increasing the size and weight of the sign. Maintenance of portability has previously dictated that electrically energized devices, i.e., light sources, not be used in such signs because the power requirements for such light sources would require unduly large and heavy batteries.

SUMMARY OF THE INVENTION

The present invention overcomes the above briefly discussed and other deficiencies and disadvantages of the prior art and, in so doing, augments the lettered messages of prior art portable warning signs by adding thereto electrically energized flashing light messages. Thus, in accordance with the preferred embodiment of the invention, the letters of the instructional message provided on the opposite sides of a manually supported and operated sign are each provided with an array of high intensity light emitting diodes (LED's) which define the same letter. Also in accordance with the preferred embodiment, all of the light emitting diodes associated with at least one side of the sign, and typically both sides thereof, are simultaneously and periodically energized. The construction of the sign or message board, and particularly the manner in which the LED's are packaged along with their integral control circuitry, does not add significantly to the size and weight of the sign.

A further feature of the present invention includes the provision, at the opposite end of the support post for the above-described sign board, of a "plug in" rechargeable battery which is packaged so as to be easily removed for recharging. When in use, the housing for the battery functions as the base of the pole, i.e., the ground contacting support which allows the sign to be manually rotated.

The present invention, through the use of high intensity, i.e., very bright, LED's as the light sources, and by operating the LED's in a pulsed mode with the appropriate duty cycle, significantly enhances visibility, and particularly increases the distance from which the sign will be seen. At the same time, the employment of LED arrays with intermittent energization permits use of a comparatively small and relatively light weight power source and, particularly, a battery pack similar to the type previously employed in portable hand tools.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENT

Figure 1B:
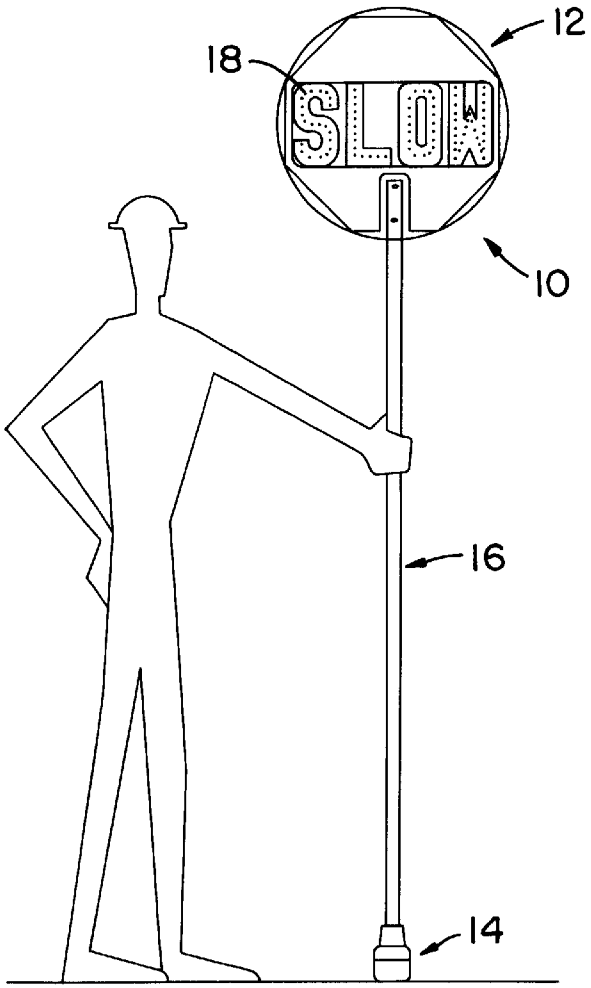
FIGS. 1A and 1B, respectively, depict an illuminated warning sign in accordance with the invention with different messages displayed.
Figure 1A:
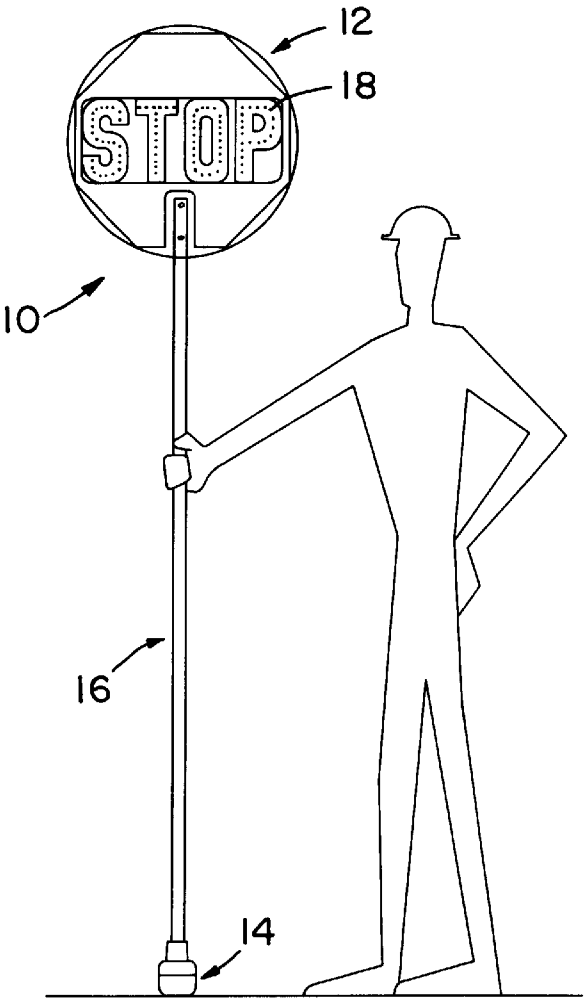
Figure 2:
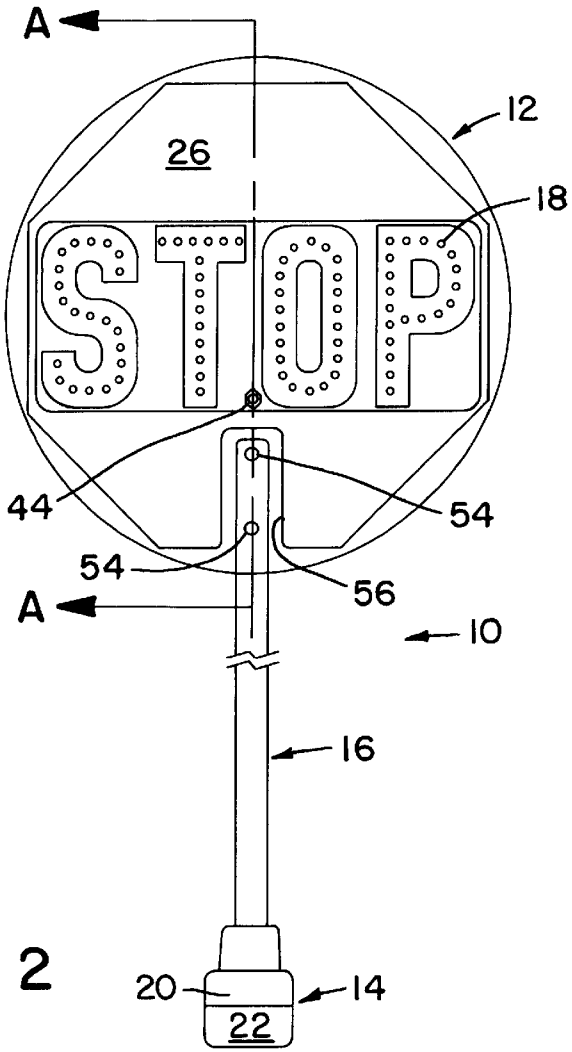
FIG. 2 is a front elevational view of the sign of FIG. 1 depicted in the orientation of FIG. 1A.

With reference now to the drawings, a warning sign in accordance with the present invention is indicated generally at 10 in FIGS. 1 and 2. The three major components of sign 10 are the message or sign board 12, a two piece base 14 and the pole 16 which interconnects the board and base. As may be seen by comparison of FIGS. 1A and 1B, board portion 12 of sign 10 bears a different printed informational message, i.e., an instruction word, on each side. Each of the letters comprising these words is further outlined by a linear array of light emitting diodes 18. In one reduction to practice of the invention, the LED's 18 comprised 5 mm A1InGaP devices which, when energized, generate 2000 millicandella. The LED arrays, as clearly shown, are positioned within the bounds of the printed letters. Thus, when energized, the LED's will increase the distance from which the information to be conveyed may be read and will reinforce the message, i.e., STOP or SLOW in the disclosed example. The board portion 12 of sign 10 also contains all of the electrical circuitry for controlling energization of the LED arrays.

As will be described in greater detail below in the discussion of FIGS. 5 and 6, and as may be seen from FIG. 2, the base portion 14 of sign 10 is comprised of a hollow or cup-like upper housing 20 and a lower housing 22. Upper housing 20 will be permanently affixed to pole 16 and will include an electrical receptacle, i.e., a pair of stationary contacts. Lower housing 22 comprises a battery pack with male terminals which is partly received in upper housing 20. Insertion of lower housing 22 into upper housing 20 will establish an electrical connection between the contacts of the receptacle in housing 20 and the terminals of the battery.

Pole 16, in the interest of minimizing weight, is preferably a PVC pipe which, at its lower end, is bolted to the upper housing 20 of base 14. The pipe 16, at its upper end, defines a receptacle for board 12. Board 12 and the upper end of pole 16 are mechanically interconnected by a pair of bolts 54 (see FIGS. 2 and 4).

Figure 4:
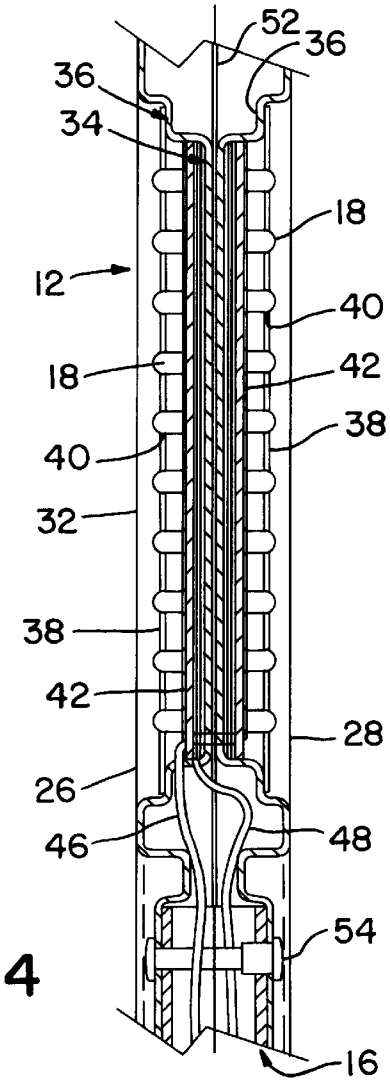
FIG. 4 is an enlarged, cross-sectional side elevation view taken along line A—A of FIG. 2.
Figure 3:
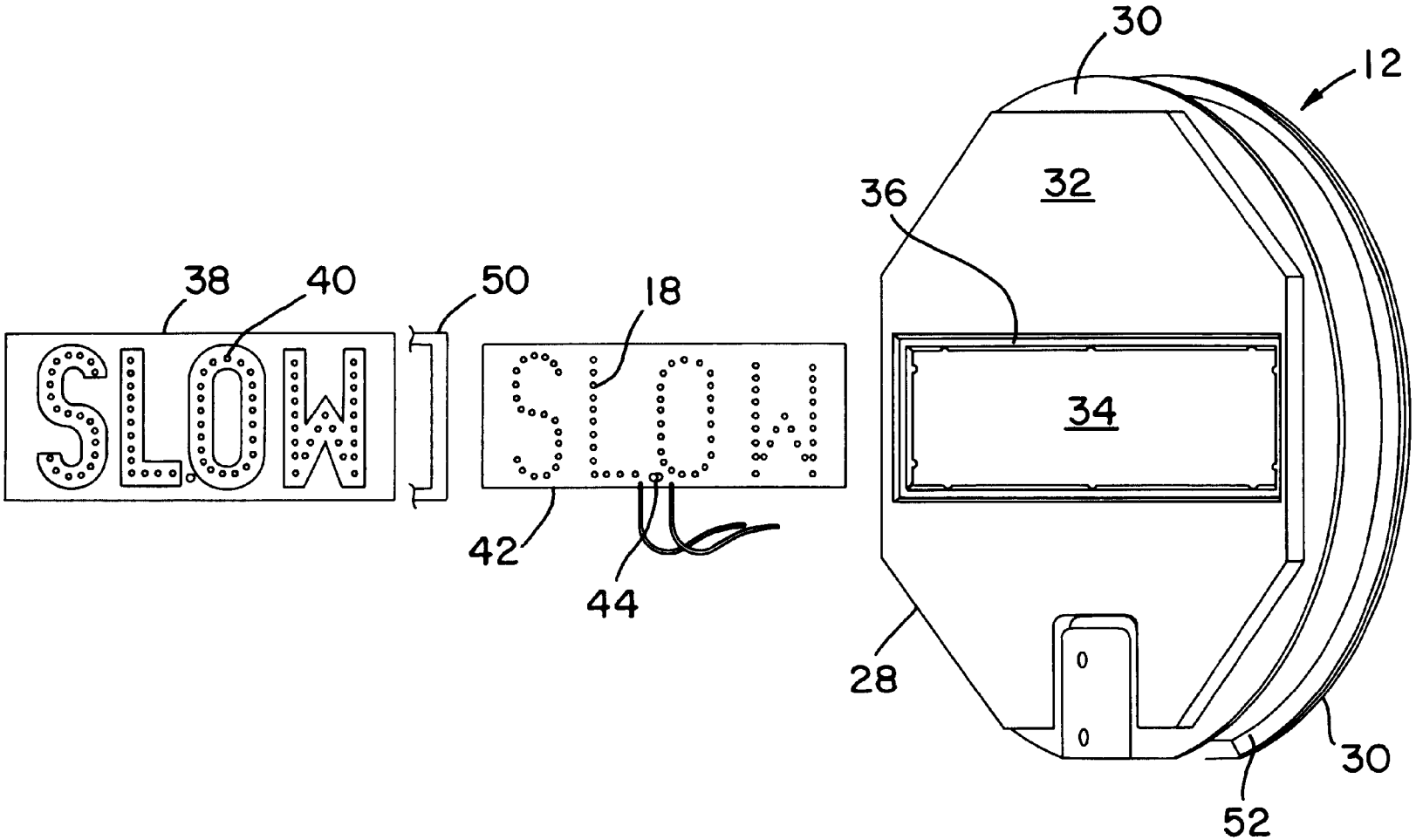
FIG. 3 is a partial, exploded, perspective view of the message board portion of the sign of FIGS. 1 and 2.

Referring jointly to FIGS. 3 and 4, board portion 12 of sign 10 comprises a pair of molded or thermo-formed plastic housing members 26 and 28. Each of housing members 26 and 28 includes a rim portion 30 and a raised center portion 32 which, in the enclosed embodiment, has a generally octagonal shape. A stepped rectangular recess 34 is provided in each of the raised portions 32. As may be seen from FIG. 4, the recesses 34 have a base portion which is coplanar with the rim portion 30. The recesses 34 also, intermediate the plane of the base portion and the plane of the surface of the surface of raised portion 32, are provided with a mounting shoulder 36.

The printed warning messages are carried by dye-cut plastic panels 38 which are formed from a plastic material having a color which matches that of the housing members 26 and 28. Clearance holes 40 are provided in the panels 38 for receiving the LED's 18. The letters comprising the written message are silk-screened on the surfaces of panels 38 which will face outwardly. The clearance holes 40 are, of course, arranged so as to outline the letters which are printed on the panels 38 and to lie within the bounds of the printing as shown.

The LED's 18 are mounted on circuit boards 42 in such a manner as to project through the clearance holes 40. The circuit boards 42 provide the interconnections such that, in the disclosed embodiment, all of the LED's 18 on a circuit board 42 will be simultaneously and periodically energized. Other arrangements are, of course, possible. For example, control circuitry could be provided such that the LED arrays defining each letter are individually and sequentially energized.

In the interest of both minimizing power consumption and enhancing the ability to attract attention, a sign in accordance with the present invention has its light sources, i.e., the LED arrays, operated in a flashing mode. It has also been found desirable, in the interest of reducing complexity and the need for operator attention, to have the LED arrays on both sides of the sign simultaneously energized. The control circuitry for sign 10 comprises a solid state switch, not shown. Depending upon the impedance and power requirements of the individual LED's, groups of these light sources will be connected in series and the several groups will be connected in parallel with all the electrical connections being in the form of conductors printed on the boards 42. Depending on the desired operational mode, energization of the LED's can be via a single solid state switch on one of the circuit boards 42 or a switch can be provided on each of the circuit boards. The "closing" of the switch(es) will be accomplished under the control of a timing circuit, included on one of the circuit boards, which establishes the duty cycle, i.e., the relative length of the on and off times of the light sources. In a typical example, the light sources on each side of sign 10 will be operated with a fifty percent (50%) duty cycle. In one reduction to practice of the invention, where the LED's on the opposite sides of the sign were alternately energized, a timing circuit for controlling energization of the solid state switches was provided on each of circuit boards 42 and a through-hole connector was provided to transmit synchronizing signals from one of these circuit boards to the other. The timing circuit or circuits may comprise type 555 integrated circuit timers, also not shown.

As indicated at 44 in FIG. 2, an on/off switch may be mounted on message board 12 for manually establishing or interrupting the circuit between the power source in base 14 and the circuitry on circuit boards 42. Switch 44 has been eliminated, in the interest of facilitating the understanding of the invention, from FIG. 4. As indicated on FIG. 3, it is also possible to employ a switch 44 on each of the circuit boards 42 so that the illuminated messages on the opposite sides of the board may be individually activated or deactivated. As an alternative, a mercury switch or switches, also not shown, can be employed in either the board 12 or base 14 to automatically establish a connection between the power source and circuit boards when sign 10 is raised to its use position.

In one method of assembly of the sign 10, each of the circuit boards 42 is secured, by any suitable means, in the recess 44 of a respective housing half. The circuit boards will, of course, be treated to afford protection against moisture and shock damage to the conductive paths and components carried thereby. The circuit boards 42 will, when mounted, become an integral part of the sign housing. Through connections will be provided in the base portions of the recesses 34 to establish paths for the delivery of current to the circuitry on each circuit board and, if necessary, to provide a path for transmission of synchronizing and/or switch control signals from one of the circuit boards to the other. In a typical installation, one of the circuit boards 42 will be provided with a two conductor cable which extends from the board down the interior of the pole 16. The two conductors are schematically illustrated in FIG. 4 at 46 and 48.

After the circuit boards 42 have been mounted in the recesses 34, the die-cut plastic panels 38 are positioned so as to be supported on the shoulders 36 of recesses 34 with the LED's 18 projecting through the clearance holes 40. Referring to FIG. 3 the panels 38 are secured in position on the shoulders 36 through the use of high bond double faced tape 50.

The next step in the assembly process is to join the two housing halves 26 and 28. This is accomplished through the use of high bond double faced tape indicated at 52 in FIGS. 3 and 4.

The message board 12 is mounted on the pole 16 in the manner shown using bolts 54. To this end, the message board housing halves 26 and 28 are provided with molded recesses 56.

Figure 5:
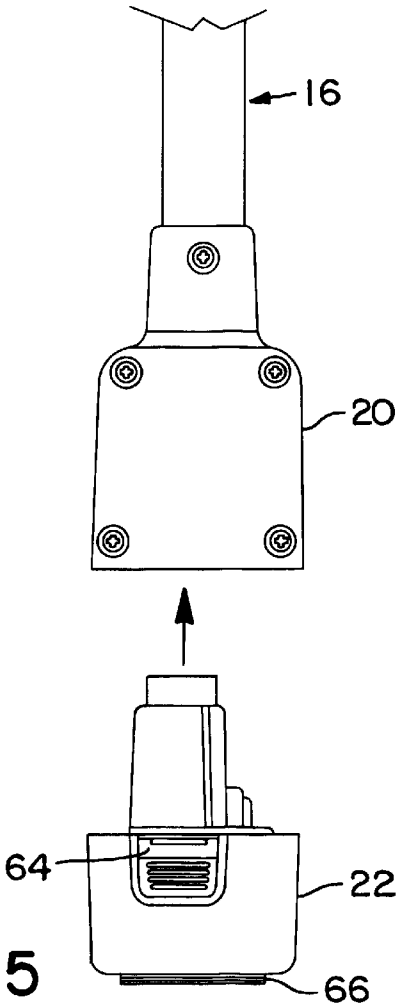
FIG. 5 is an exploded view of the lower portion of the sign of FIGS. 1–4, FIG. 5 depicting the manner in which the power source is coupled to the remainder of the sign.
Figure 6:
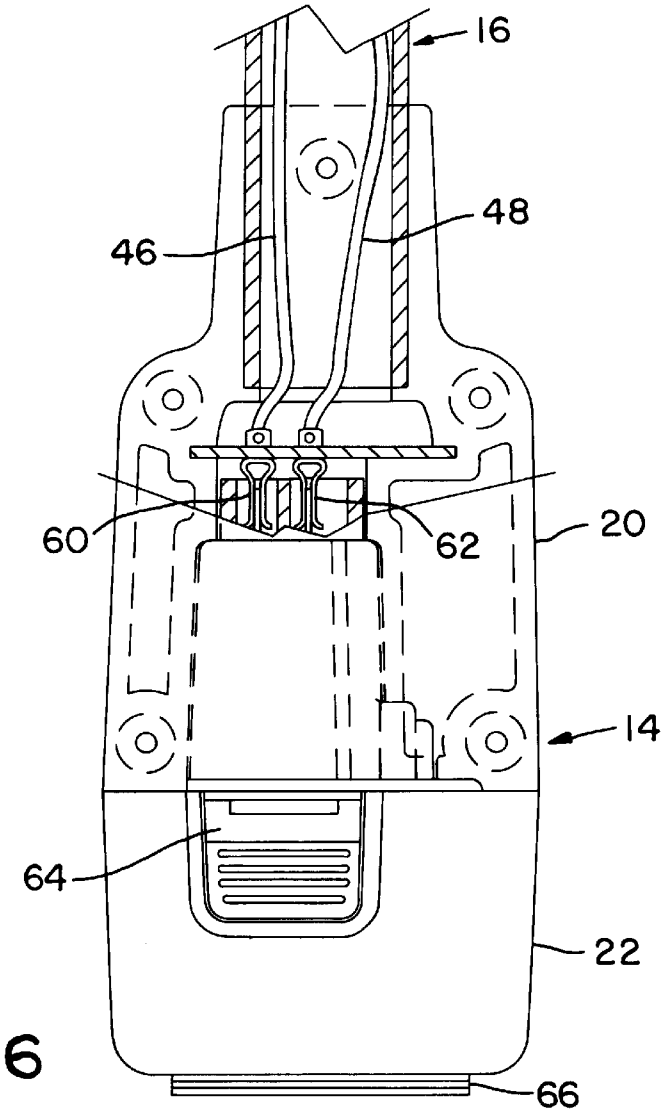
FIG. 6 is an enlarged, schematic view, partly in section, corresponding to the showing of FIG. 5, FIG. 6 depicting the power source coupled to the remainder of the sign.

With reference to FIGS. 5 and 6, the conductors 46 and 48 of the power supply cable which extend from the message board 12 terminate at a pair of stationary female connectors 60 and 62 in upper portion 20 of base 14. The rechargeable battery which supplies electrical power for operation of the LED's arrays of message board 12 is housed in lower portion 22 of base 14. When the two portions of base 14 are engaged, and these two portions may be engaged only in a single orientation, male terminals associated with the appropriate plurality terminals of the battery will engage the connectors 60 and 62. A mechanical release button 64, the operational mechanics of which have not been shown, is provided on portion 22 of base 14 to enable release of the battery so that it may be connected to a charger. A molded pad 66 is provided on the bottom of lower portion 22 of base 14 for supporting the entire sign 10 from the ground. The composition of pad 66 is such that it will enable the sign 10 to be easily rotated without the pad itself undergoing excessively rapid wear.

The actual battery has not been shown in the drawings. It should suffice to note that the battery snaps into portion 22 of base 14 and may be replaced.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A warning device comprising:

a sign, said sign including a base, said base having a pair of oppositely facing sides, at least a first of said signs bearing a printed message;

a plurality of light emitters supported on said base, said light emitters being arranged to provide an illuminated display commensurate with the printed message;

an electrical circuit for intermittently delivering energizing current to said light emitters;

a source of energizing current, said source of energizing current including a rechargeable battery, and further including a housing for said battery;

an elongated tubular support pole having a pair of opposite ends, a first end of said pole being mechanically coupled to said base of said sign, the second end of said pole being mechanically connected to said housing of said current source; and means for electrically connecting said current source to said circuit of said sign, said means for electrically connecting including electrical conductors routed within said pole, said printed message on said base of said sign consisting of multiple characters and wherein said base further comprises a plurality of apertures, said apertures being located within the boundaries of each of said characters and defining aperture arrays which outline said characters, and wherein said electrical circuit includes at least a first printed circuit board, said light emitters being mounted on said board, said board being supported from said base such that said light emitters extend through respective apertures of said plurality of apertures, said base of said sign defines a recess for receiving said circuit board, said base further comprising a message panel on which said characters are printed, said apertures being formed in said panel and said panel being at least in part in registration with said recess, said panel overlying said circuit board and isolating said circuit board from the ambient environment.

2. The warning device of claim 1 wherein said base and said pole are fabricated from a plastic.

3. The warning device of claim 1 wherein said light emitters comprise light emitting diodes.

4. A warning device comprising:

a sign, said sign including a base, said base having a pair of oppositely facing sides, at least a first of said signs bearing a printed message;

a plurality of light emitters supported on said base, said light emitters being arranged to provide an illuminated display commensurate with the printed message;

an electrical circuit for intermittently delivering energizing current to said light emitters;

a source of energizing current, said source of energizing current including a rechargeable battery, and further including a housing for said battery;

an elongated tubular support pole having a pair of opposite ends, a first end of said pole being mechanically coupled to said base of said sign, the second end of said pole being mechanically connected to said housing of said current source; and means for electrically connecting said current source to said circuit of said sign, said means for electrically connecting including electrical conductors routed within said pole, said housing of said current source including:

an upper housing portion, said upper housing portion being affixed to said second end of said pole and including at least a first pair of stationary electrical contacts;

a lower housing portion, said lower housing portion being releasably coupled to said upper housing portion, said lower housing portion mounting said battery and including a second pair of electrical contacts, the contacts of said second pair being electrically connected to respective contacts of said first pair when said upper and lower portions are coupled together; and a support pad mounted to the exterior of said lower housing portion whereby said warning device may be rotatably supported from the ground with the warning message vertically displaced from the ground by a distance appropriate to enhancing visibility of said warning device.

5. The warning device of claim 4 wherein said printed message on said base of said sign consists of multiple characters and wherein said base further comprises a plurality of apertures, said apertures being located within the bounds of each of said characters and defining aperture arrays which outline said characters, and wherein said electrical circuit includes at least a first printed circuit board, said light emitters being mounted on said board, said board being supported from said base such that said light emitters extend through associated of said apertures.

6. The warning device of claim 5 wherein said base of said sign defines a recess for receiving said circuit board, said base further comprising a message panel on which said characters are printed, said apertures being formed in said panel and said panel being mounted within said recess and in registration with said circuit board, said panel isolating said circuit board from the ambient environment.

7. The warning device of claim 5 wherein said light emitters comprise light emitting diodes and wherein said apertures in said message panel and said diodes are arranged in singular arrays which define each of said message characters.

8. A warning device comprising:

a sign, said sign including a base, said base having a pair of oppositely facing sides, at least a first of said signs bearing a printed message;

a plurality of light emitters supported on said base, said light emitters being arranged to provide an illuminated display commensurate with the printed message;

an electrical circuit for intermittently delivering energizing current to said light emitters;

a source of energizing current, said source of energizing current including a rechargeable battery, and further including a housing for said battery;

an elongated tubular support pole having a pair of opposite ends, a first end of said pole being mechanically coupled to said base of said sign, the second end of said pole being mechanically connected to said housing of said current source; and means for electrically connecting said current source to said circuit of said sign, said means for electrically connecting including electrical conductors routed within said pole, said base bears messages on both of said signs, said messages being different and each message consisting of multiple characters, said base including:

a pair of base members, said members each having a peripheral rim portion and a raised center portion, said center portion of each base member further being provided with a recess, said base members being joined together in said portions thereof;

a pair of message panels, one of said multiple character messages being printed on each of said panels, said panels being fixed to respective base members of said pair of base members so as to be in registration with one of said recesses in one of said pair of base members, said panels each being provided with arrays of apertures which outline the characters of the message printed thereon, said apertures being located within the bounds of each printed character.

9. The warning device of claim 8 wherein said electrical circuit comprises:

a pair of printed circuit boards, said boards being mounted within a respective recess of said recesses and said base member center portions whereby said circuit boards are located behind respective message panels of said pair of message panels, said light emitters being supported on said boards in accordance with a mounting pattern which matches the apertures and said message panels whereby said light emitters project through respective apertures of said arrays of apertures.

10. The warning device of claim 9 wherein said electrical circuit further comprises:

switch means for periodically energizing said emitters whereby said printed warning messages are emphasized by flashing illuminated messages.

11. The warning device of claim 10 wherein said housing of said current source comprises:

an upper housing portion, said upper housing portion being affixed to said second end of said pole and including at least a first pair of stationary electrical contacts;

a lower housing portion, said lower housing portion being releasably coupled to said upper housing portion, said lower housing portion mounting said battery and including a second pair of electrical contacts, the contacts of said second pair being electrically connected to respective contacts of said first pair when said upper and lower portions are coupled together; and a support pad mounted to the exterior of said lower housing portion whereby said warning device may be rotatably supported from the ground with the warning message vertically displaced from the ground by a distance appropriate to enhancing visibility of said warning device.

12. The warning device of claim 11 wherein said light emitters comprise light emitting diodes and wherein said apertures in said message panel and said diodes are arranged in singular arrays which define each of said message characters.

13. The warning device of claim 10 wherein said light emitters comprise light emitting diodes.

14. The warning device of claim 8 wherein said base members, said message panels, and said pole are fabricated from plastic.

15. The warning device of claim 14 wherein said base members, said message panels, and said pole are fabricated from plastic.

16. A warning device comprising:

a sign, said sign including a base portion, said base portion having a pair of oppositely facing sides, at least a first of said sides defining a multiple character printed message, said base portion further having plural arrays of apertures extending therethrough, said apertures of each array being located within the bounds of a respective character of said multiple character printed message, said apertures of each of said arrays defining a pattern commensurate with the respective character;

a plurality of light emitting diodes supported on and projecting through said base portion, said diodes being arranged to provide an illuminated display commensurate with the printed message; and an electrical circuit for intermittently delivering energizing current to said diodes, said electrical circuit including at least a first printed circuit board, said diodes being mounted on said board, said board being supported from said base portion such that each of said diodes extends through one of said apertures;

a source of energizing current, said source of energizing current including a rechargeable battery, and further including a housing for said battery;

an elongated tubular support pole having a pair of opposite ends, a first end of said tubular support being mechanically coupled to said base portion of said sign, the second end of said tubular support being mechanically connected to said housing of said current source; and means for electrically connecting said current source to said circuit of said sign, said means for electrically connecting including electrical conductors routed within said tubular support.

* * * * *